US007611027B2

(12) United States Patent
Kim

(10) Patent No.: US 7,611,027 B2
(45) Date of Patent: Nov. 3, 2009

(54) BOTTLE CAP AND A BOTTLE WITH THE SAME

(76) Inventor: Sang-Hoon Kim, Mapo Taeyeong Apt. 109-701, 660 Daeheung-dong, Mapo-gu, Seoul, 121-811 (KR)

( * ) Notice: Subject to any disclaimer, the term of this patent is extended or adjusted under 35 U.S.C. 154(b) by 445 days.

(21) Appl. No.: 10/569,930

(22) PCT Filed: Aug. 28, 2004

(86) PCT No.: PCT/KR2004/002165

§ 371 (c)(1),
(2), (4) Date: Feb. 27, 2006

(87) PCT Pub. No.: WO2005/021395

PCT Pub. Date: Mar. 10, 2005

(65) Prior Publication Data

US 2007/0007230 A1 Jan. 11, 2007

(30) Foreign Application Priority Data

Aug. 30, 2003 (KR) ..... 20-2003-0027966 U

(51) Int. Cl.
*B65D 41/00* (2006.01)

(52) U.S. Cl. ..... 215/305; 215/253; 215/250; 220/266; 220/265; 220/270

(58) Field of Classification Search ..... 215/253, 215/305, 250, 235; 220/266, 265, 270
See application file for complete search history.

(56) References Cited

U.S. PATENT DOCUMENTS 775,651 A * 11/1904 Heath ..... 215/305
2,156,258 A * 5/1939 Atwood ..... 215/253
2,669,369 A * 2/1954 Towns ..... 215/305
2,778,520 A * 1/1957 Hyde, Jr. ..... 215/253
3,200,982 A * 8/1965 Cormier ..... 215/253
3,325,032 A * 6/1967 Cormier ..... 215/253
3,425,580 A * 2/1969 Brockhage ..... 215/305
3,603,473 A * 9/1971 Winberg ..... 215/250
3,782,576 A * 1/1974 Jacquemijns ..... 215/253
3,865,268 A * 2/1975 Coop ..... 215/253

(Continued)

*Primary Examiner*—Nathan J Newhouse
*Assistant Examiner*—Christopher B McKinley
(74) *Attorney, Agent, or Firm*—Cantor Colburn LLP

(57) ABSTRACT

Disclosed is a bottle cap 100 that is detachably assembled with an adjacent portion 2 of an opening of a bottle 1, and the bottle with the same. The bottle cap 100 is comprised of a circumferential portion 10 that is shaped to wrap up an outer surface of the adjacent portion 2 of the opening therein; a cap portion 20 that closes an upper side of the circumferential portion 10; a plurality of tamper indication portions 30 respectively extended from a central area of the circumferential portion 10 to a lower end thereof; a bending portion 40 that connects upper ends of the respective tamper indication portions 30 in a line; an opening piece portion 50 comprised of the plurality of tamper indication portions 30 and the bending portion 40; and a recess portion 70 so formed on an inner surface of the circumferential portion 10 as to prevent separation. Accordingly, it is possible to open and close the bottle cap merely with a simple operation with a single hand, to secure the area for the advertisement or the like sufficiently, to reduce the manufacturing costs by reducing the height of the bottle cap, and to increase the productivity by simplifying the manufacturing process.

15 Claims, 11 Drawing Sheets

U.S. PATENT DOCUMENTS 3,899,097 A * 8/1975 Aichinger ..... 215/253
3,985,255 A * 10/1976 Blair ..... 215/254
4,055,267 A * 10/1977 Blair ..... 215/254
4,371,089 A * 2/1983 Barendregt ..... 215/256
4,423,822 A * 1/1984 Powalowski ..... 215/365
4,548,329 A * 10/1985 Curry ..... 215/216
4,721,210 A * 1/1988 Lawrence et al. ..... 206/459.1
4,752,013 A * 6/1988 Miller et al. ..... 215/216
4,951,829 A * 8/1990 Hsu ..... 215/253
4,966,294 A * 10/1990 Mack et al. ..... 220/266
4,986,430 A * 1/1991 Dutt ..... 215/253
5,147,305 A 9/1992 Nakamura et al.
5,292,017 A * 3/1994 Reifers ..... 215/206
5,447,247 A * 9/1995 Derksen ..... 215/247
5,636,756 A * 6/1997 Johnson ..... 215/206
5,836,468 A * 11/1998 Bosl et al. ..... 215/253
5,975,320 A * 11/1999 Bietzer et al. ..... 215/254
5,984,125 A * 11/1999 Price et al. ..... 215/253
6,102,226 A * 8/2000 Verderber ..... 215/254
6,299,005 B1 * 10/2001 Higgins ..... 215/237
6,375,023 B1 * 4/2002 Lecinski et al. ..... 215/253
6,631,820 B2 * 10/2003 Harrold et al. ..... 215/237
6,655,553 B2 * 12/2003 Staniszewski et al. .. 222/153.07
6,681,947 B2 * 1/2004 Kim et al. ..... 215/254
6,860,397 B1 * 3/2005 Walters, Jr. ..... 215/305
7,051,888 B2 * 5/2006 Antier et al. ..... 215/235
7,281,636 B2 * 10/2007 Kim et al. ..... 215/254
7,281,638 B2 * 10/2007 Hierzer et al. ..... 220/257.1
2002/0079282 A1 * 6/2002 Harrold et al. ..... 215/237
2003/0057174 A1 * 3/2003 Folchini et al. ..... 215/253
2006/0043053 A1 * 3/2006 Herald et al. ..... 215/253

* cited by examiner

BOTTLE CAP AND A BOTTLE WITH THE SAME

FIELD OF THE INVENTION

The present invention relates to a bottle cap, and more particularly, to a bottle cap that has tamper indication means and can be opened with a simple operation by one hand and a bottle with the same.

BACKGROUND OF THE INVENTION

The product containing beverage or the like to be sold generally has a tamper indication means for providing the means for confirming the first opening thereof. The tamper indication means is a means for providing confidence that the bottle containing the beverage, drug or the like is provided to the consumer without any prior experience of opening, which is required to have the construction that cannot be opened without the trace of opening such as the cutting of the tamper indication means.

There are several prior arts concerning the tamper indication means such as U.S. Pat. Nos. 5,074,425 and 3,673,761 (Leitz/CIBA-Geigy AG), Germanic Patent No. OS-14 82 603 (Teillac/ALCA S.A.), etc.

FIGS. 15 and 16 show a general conventional construction of the bottle cap having the tamper indication means.

As shown in the drawings, the conventional bottle cap 200 is comprised of a circumferential portion 210 that is shaped to wrap up the outer surface of the opening of a bottle and has a spiral structure (not shown) on the inner surface thereof, a cap portion 220 formed to close the upper side of the circumferential portion 210, and a tamper indication means 230.

Here, the tamper indication means 230 is comprised of a band 231 that is so formed around the lower end of the circumferential portion 210 as to wrap up the outer surface of the opening of the bottle, and a plurality of connection bridges 232 that connect the band 231 and the circumferential portion 210 with each other. When the bottle cap 200 is first opened, the circumferential portion 210 and the band 231 are separated from each other by cutting.

Further, in order to separate the band 231 from the bottle after the connection bridges 231 are cut off by the first opening of the bottle cap 200, there would be equipped a cut-off portion 240 that is cut off at a certain position on the band 231 and a connection part 240 that connects the band 231 with the lower end of the circumferential portion 210 of the bottle cap 200.

The tamper indication means 230 is required only when the bottle cap 200 is first opened. Therefore, as shown in FIG. 16, the bottle cap 200 is separated from the bottle while the band 231 is hung on the bottle cap 200, and the band 231 is then removed clearly as the connection part 250 is wholly cut off by twisting it or any other manipulation. Then, the operation to assemble the bottle cap 200 with the bottle after the first opening and the operation to re-open the bottle cap 200 when the bottle cap 200 is to be re-opened are not hindered by the tamper indication means 230.

Many of conventional arts about the bottle cap with the tamper indication means have been known publicly, however, all of them have the construction that the first opening of the bottle cap and the cutting off of the connection bridge are executed in a single operation in a twisting manner as above. Therefore, in order to help the twist of the bottle cap 200, a wrinkled portion for increasing the frictional force with respect to the fingers is generally formed on the outer surface of the circumferential portion 210 of the bottle cap 200.

However, such a conventional bottle cap 200 that has the construction to be opened by the twist has the following problems.

First, after the bottle cap 200 is first opened, the piece of the tamper indication means 230 such as the band 231 will remain on the opening portion of the bottle or a certain area of the bottle cap 200, which is not helpful to the closing or the re-opening of the bottle cap 200 but is an obstacle to such operations, so there needed an additional operation to remove it.

Second, it is preferable that the cap portion 220 and the circumferential portion 210 of the bottle cap 220 include a certain amount of area to display the trademark about the content in the bottle or the advertisement, however, such an area cannot be secured in the conventional construction as the wrinkled portion for increasing the friction with respect to the finger has to be formed on the circumferential portion of the bottle cap 200.

Third, since a screw structure for opening and closing by twist has to be formed on the outer surface of the opening of the bottle and the inner surface of the bottle cap 200, the height of the bottle cap 200 has to be greater than a certain size.

Four, as a process to equip the bottle cap 200 onto the opening of the bottle by the twist thereof is required in the manufacturing process of the product that contains the content, it is hard to simplify the manufacturing process.

DETAILED DESCRIPTION OF THE INVENTION

Technical Problem

The present invention has been proposed to overcome the above problems, and it is the first object of the present invention to provide a bottle cap and a bottle with the same that it is possible to open and close the bottle cap merely with a simple operation with a single hand.

It is the second object of the present invention to provide a bottle cap and a bottle with the same that the area for the advertisement or the like can be secured sufficiently.

It is the third object of the present invention to provide a bottle cap and a bottle with the same that it is possible to reduce the manufacturing costs by reducing the height of the bottle cap, and to increase the productivity by simplifying the manufacturing process by removing the conventional screwing process.

Technical Solution

To achieve the above-described objects, the present invention provides a bottle cap that is detachably assembled with an adjacent portion of an opening of a bottle, the bottle cap comprising: a circumferential portion that is shaped to wrap up an outer surface of the adjacent portion of the opening therein; a cap portion that closes an upper side of the circumferential portion; a plurality of tamper indication portions respectively extended from a central area of the circumferential portion to a lower end thereof; a bending portion that connects upper ends of the respective tamper indication portions in a line; an opening piece portion comprised of the plurality of tamper indication portions and the bending portion; and a recess portion so formed on an inner surface of the circumferential portion as to prevent separation.

It is preferable that two tamper indication portions spaced from each other are formed.

It is preferable that said two tamper indication portions are so formed that a distance between lower portions thereof are greater than the distance between upper portions thereof.

It is preferable that each of the tamper indication portions includes: cutting line recesses formed by partially cutting away the circumferential portion; and a plurality of connection bridges that connect the cutting recesses so as to be cut off as the bottle cap is opened.

It is preferable that an opening knob protruding outward of an outer surface of the opening piece portion is additionally equipped.

It is preferable that a supporting protrusion is additionally equipped, which is so formed above the opening piece portion on the outer surface of the circumferential portion as to be contacted with the opening knob of the opening piece portion while the opening piece portion is moved upward by a cutting of the connection bridges.

It is preferable that a friction generating means provided on an outer surface of the opening knob and the supporting protrusion is additionally equipped.

The friction generating means can be a knurling, and more particularly, a wrinkled portion formed horizontally.

The circumferential portion is preferably formed by an elastic material so that an area of the opening at a lower end thereof can be changed.

It is preferable that the circumferential portion is so formed that a thickness of the upper portion thereof is greater than the thickness of the lower portion thereof.

It is preferable that a closing knob protruding upward at a central area from the upper side of the cap portion is additionally equipped.

It is preferable that a recess portion for increasing an elastic force formed on an inner side of the closing knob is additionally equipped.

The recess portion for preventing separation is preferably formed to a ring shape along the inner surface of the circumferential portion.

It is preferable that plural recess portions are formed on upper and lower areas of the inner surface of the circumferential portion.

Meanwhile, it is preferable to further comprise a cut-away portion formed on a side opposite to the opening piece portion on the circumferential portion, the cut-away portion being formed by cutting away a lower end area of the circumferential portion at a certain size.

Furthermore, a plurality of opening piece portions can be formed respectively on positions different from each other on the circumferential portion.

Meanwhile, according to another aspect of the present invention, the present invention provides a bottle cap that is detachably assembled with an adjacent portion of an opening of a bottle, the bottle cap comprising: a circumferential portion that is shaped to wrap up an outer surface of the adjacent portion of the opening therein, the circumferential portion being formed to have a cross section of trapezoidal shape so that a lower portion of the inner surface thereof is wider than an upper portion thereof, and being formed by an elastic material so that an area of an opening at a lower end thereof can be changed; a cap portion having a closing knob protruding upward at a central area of an upper side thereof, the cap portion for closing an upper side of the circumferential portion; two tamper indication portions respectively having cutting recesses formed by partially cutting away the circumferential portion, and connection bridges that connect the cutting recesses so as to be cut off as the bottle cap is opened, the tamper indication portions respectively extended from a central area of the circumferential portion to a lower end thereof and being so formed that a distance between lower portions thereof are greater than the distance between upper portions thereof; a bending portion that connects upper ends of the respective tamper indication portions in a line; an opening piece portion comprised of said two tamper indication portions and the bending portion, the opening piece portion having opening knob protruding outward of an outer surface there; a supporting protrusion that is formed above the opening piece portion on the outer surface of the circumferential portion so as to be contacted with the opening knob of the opening piece portion while the opening piece portion is moved upward by a cutting of the connection bridges; a wrinkled portion formed horizontally on an outer surface of the opening knob and the supporting protrusion; a recess portion formed to a ring shape along an inner surface of the circumferential portion, the recess portion for preventing separation; a closing knob protruding upward at a central area from the upper side of the cap portion; and another recess portion formed on an inner side of the closing knob, the recess portion for increasing an elastic force.

According to still another aspect of the present invention, the present invention provides a bottle on which the bottle cap is detachably assembled with an adjacent portion of an opening thereof, wherein the adjacent portion of the opening has a cross section of trapezoidal shape so that a lower end of an outer surface thereof is wider than an upper end thereof, and a protrusion for prevent separation that is inserted to a recess for preventing separation formed on an inner surface of the circumferential portion of the bottle cap is formed on an outer surface of the adjacent portion of the opening.

BRIEF DESCRIPTION OF THE DRAWINGS

FIGS. 1 through 12 show the embodiments of the bottle cap according to the present invention, in which FIG. 1 is a perspective view of the first embodiment, FIG. 3 is a perspective view of the second embodiment, FIG. 4 is a front view of the second embodiment, FIG. 5 is a partially cut-away view of the second embodiment, FIG. 7 is a sectional view of the third embodiment, FIG. 8 is a perspective view of the opening of the bottle of the present invention, FIG. 9 is a sectional view showing the state that the bottle cap of the third embodiment of the present invention is assembled with the bottle, FIG. 10 is a sectional view showing the state that the bottle cap of the fourth embodiment is assembled with the bottle, FIG. 11 is a sectional view showing the process that the power applied to the bottle cap of the fourth embodiment is transmitted, FIG. 12 is a bottom view of the bottle cap.

PREFERRED EMBODIMENT OF THE INVENTION

Hereinbelow, the preferable embodiments of the present invention will be described in greater detail with reference to the accompanying drawings.

Figure 1:
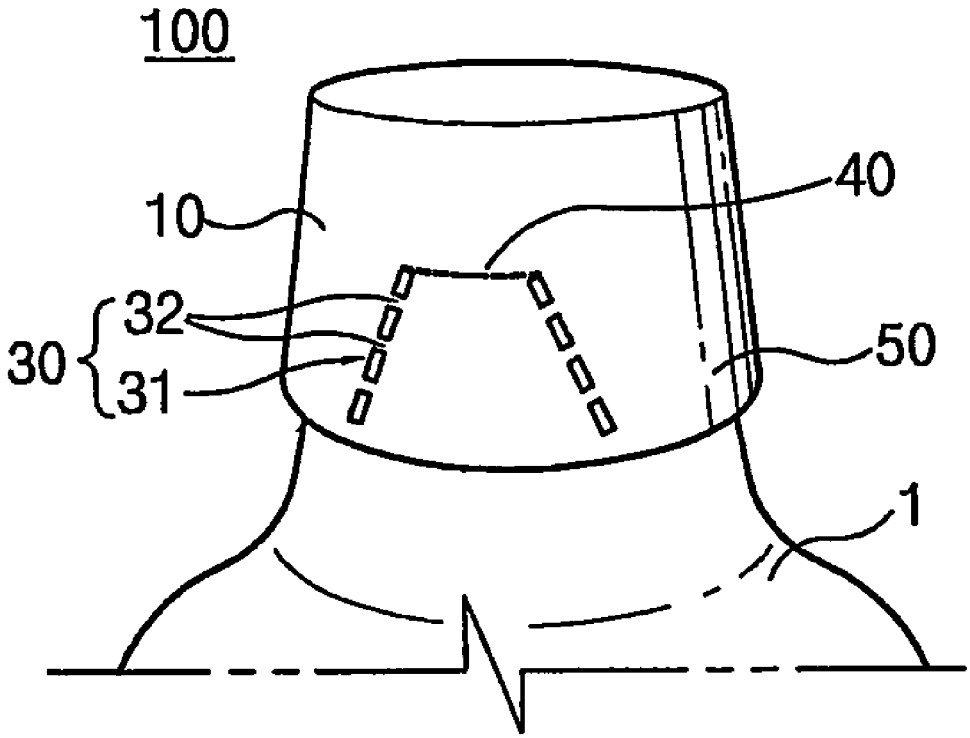
Figure 2A:
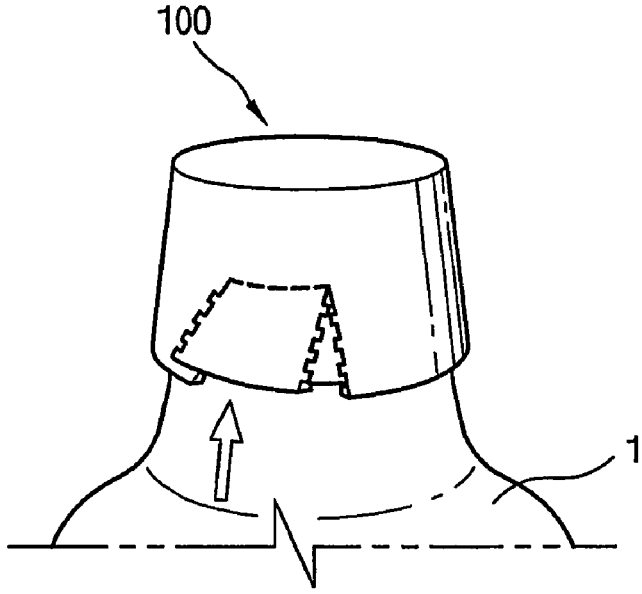
FIGS. 2A & 2B are operational views of the first embodiment.
Figure 2B:
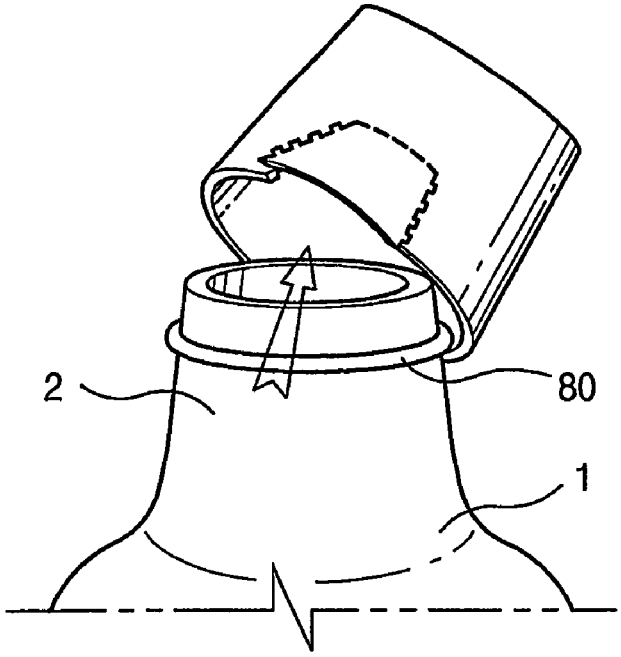
Figure 3:
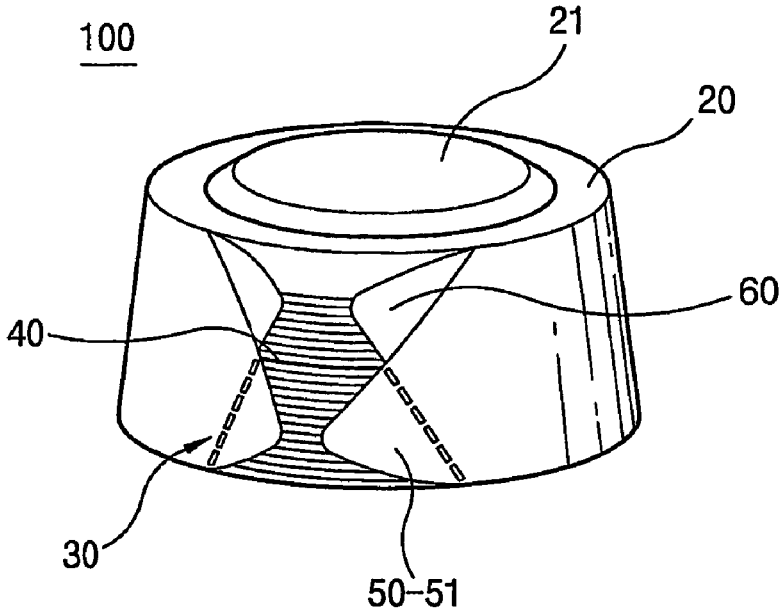
Figure 4:
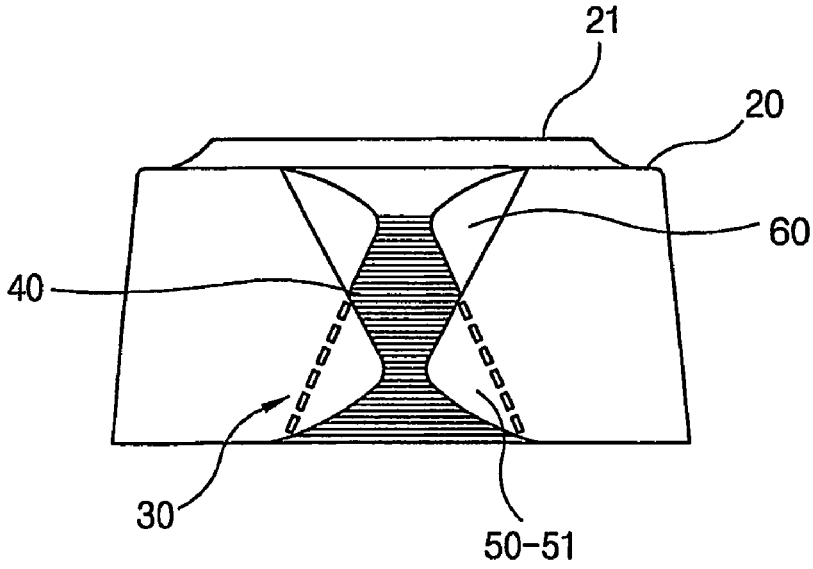
Figure 5:
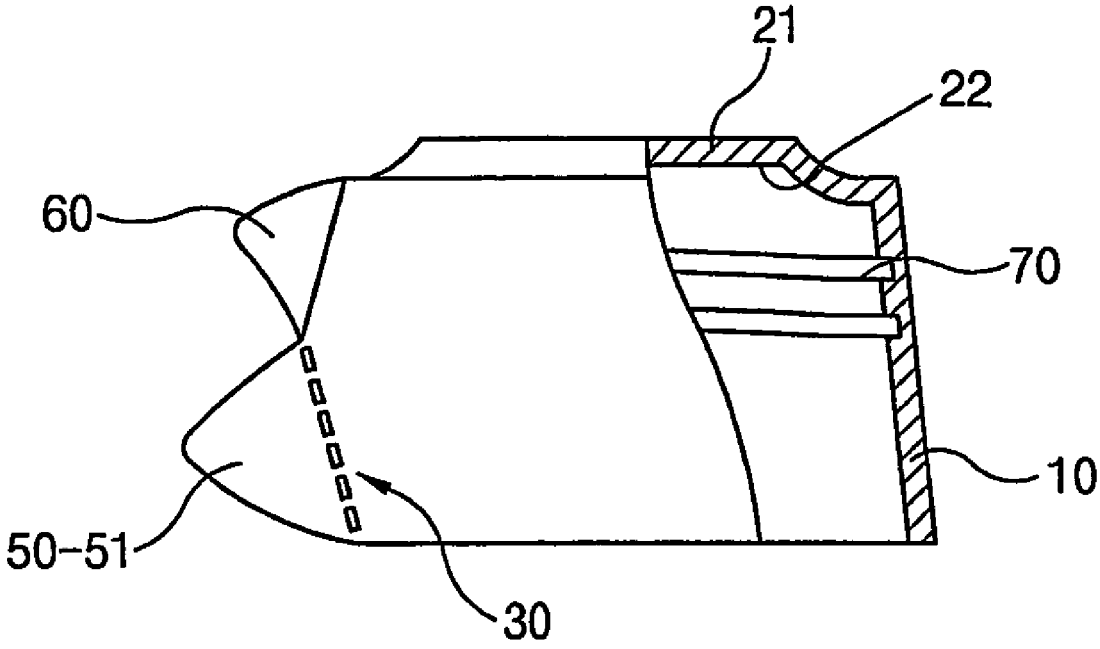
Figure 6A:
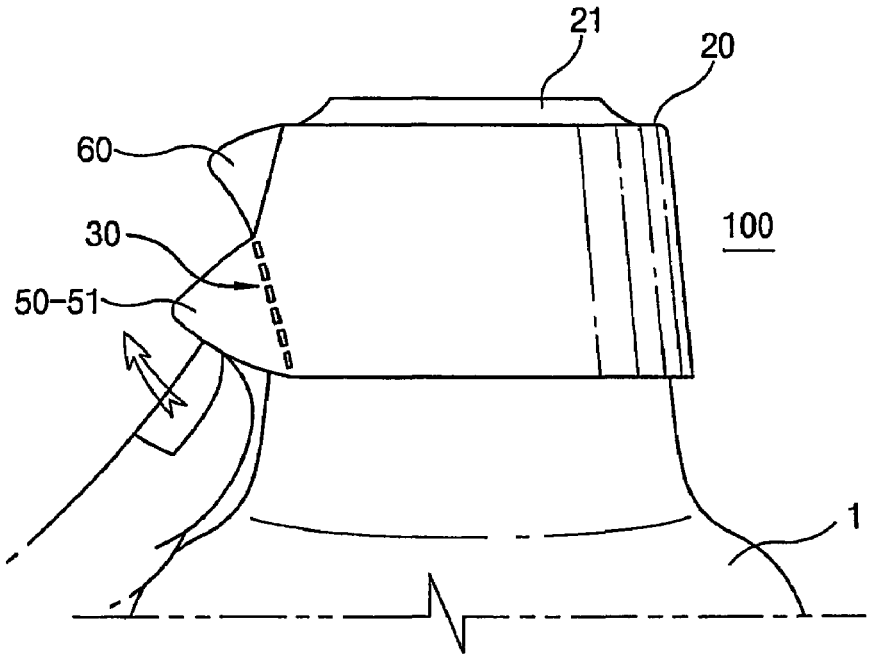
FIGS. 6A-6D are operational views of the second embodiment.
Figure 6B:
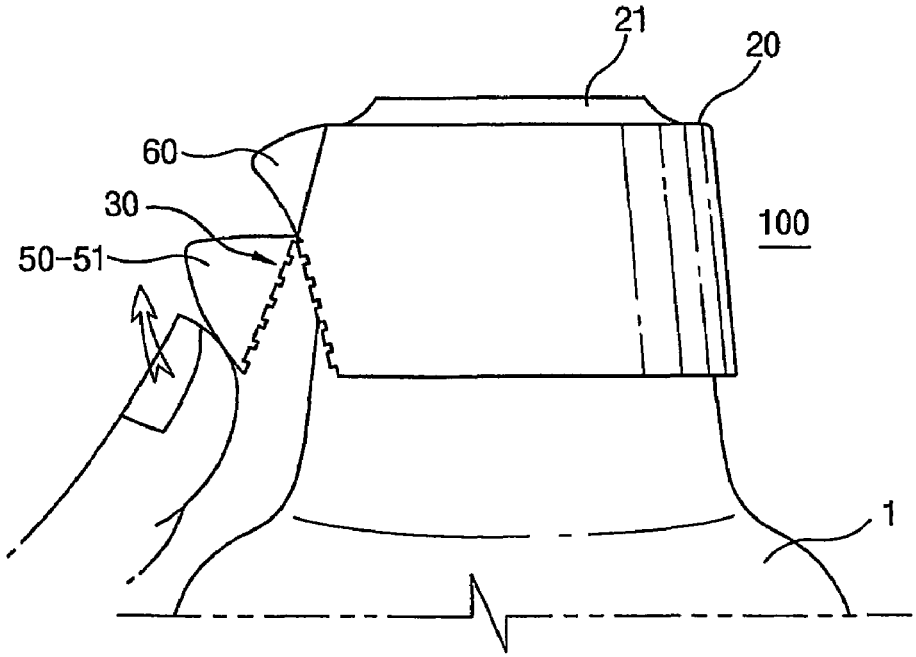
Figure 6C:
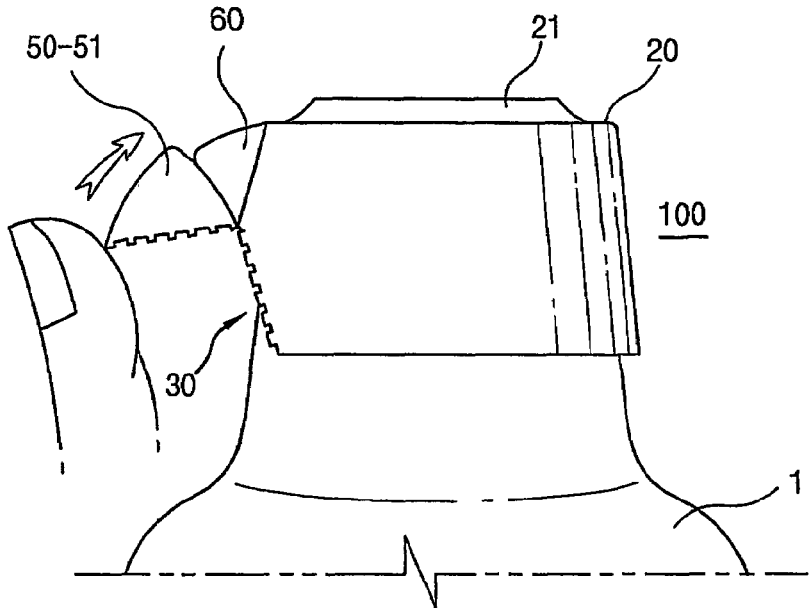
Figure 6D:
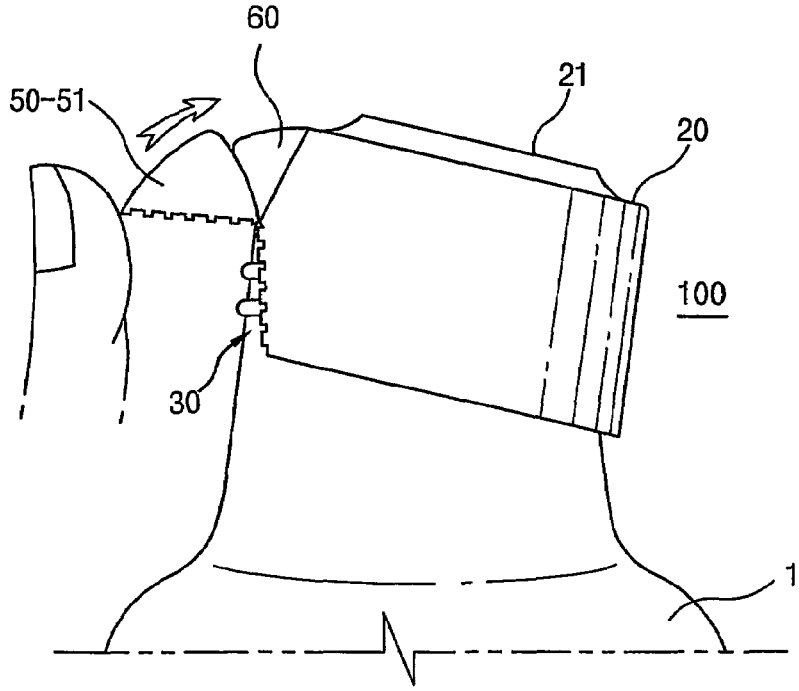
Figure 7:
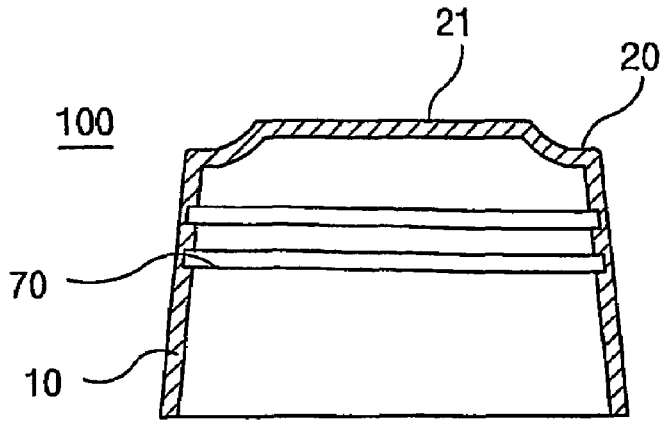
Figure 8:
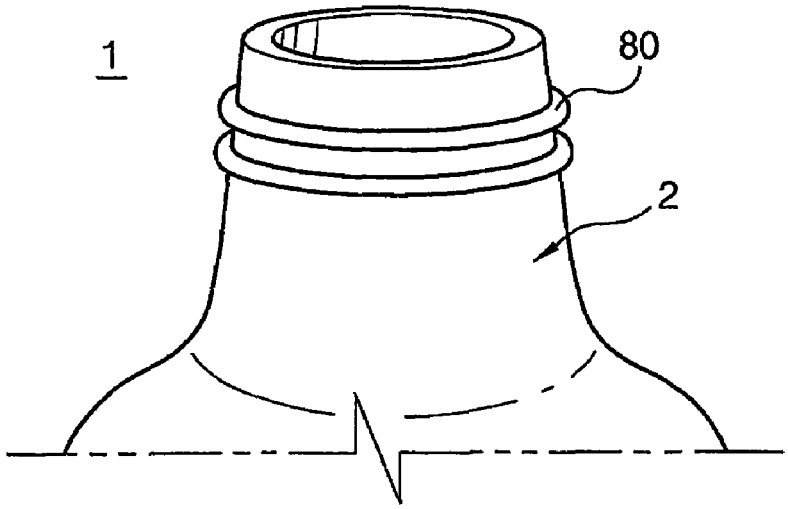
Figure 9:
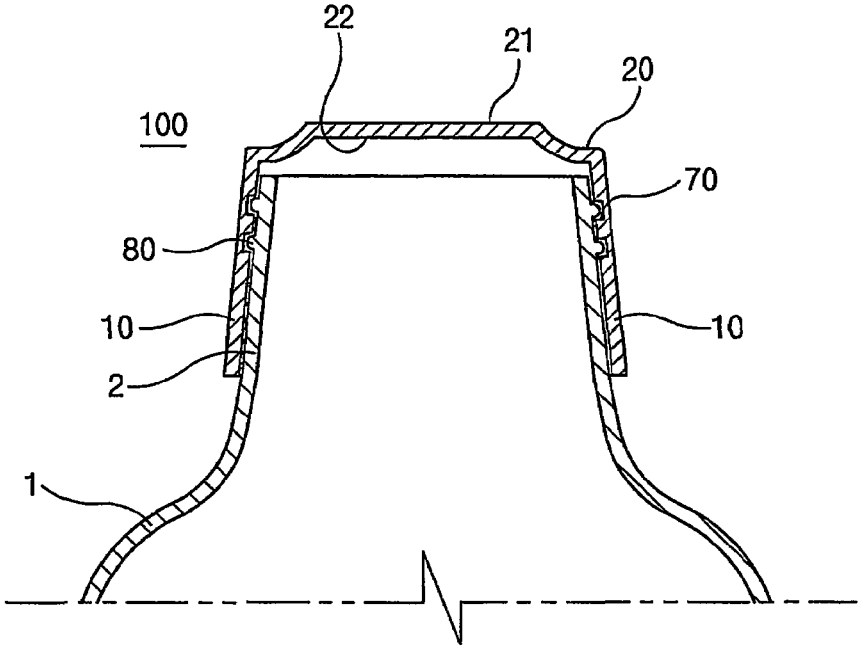
Figure 10:
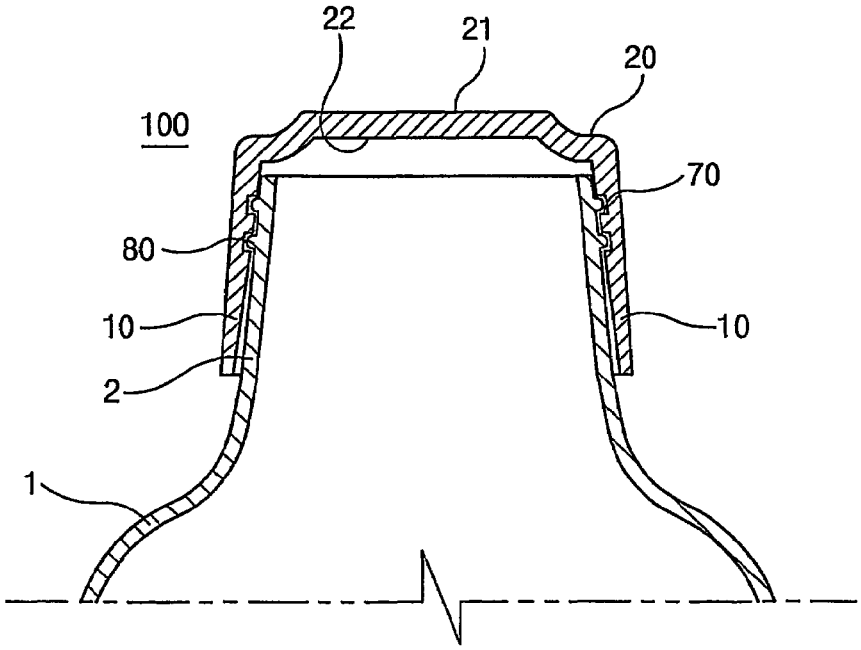
Figure 11:
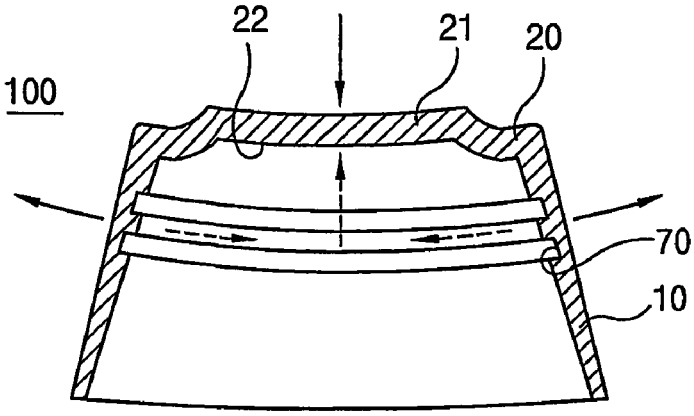
Figure 12:
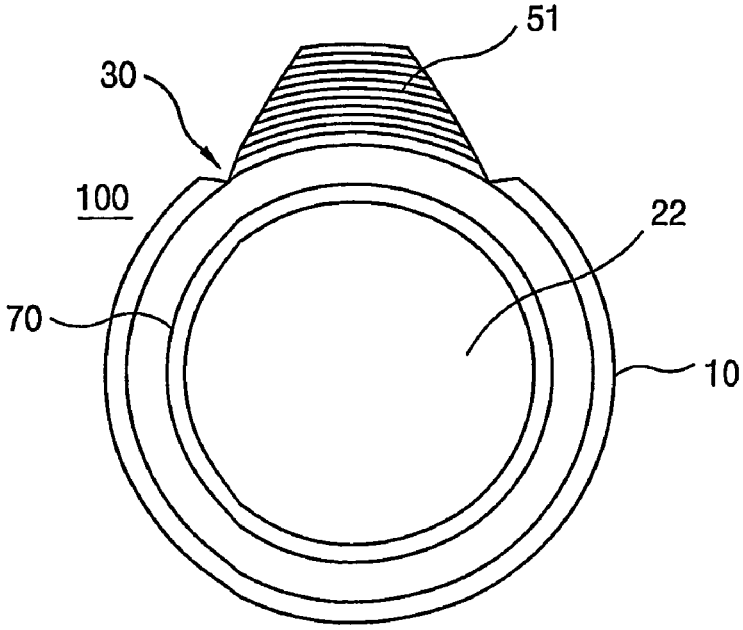
Figure 13:
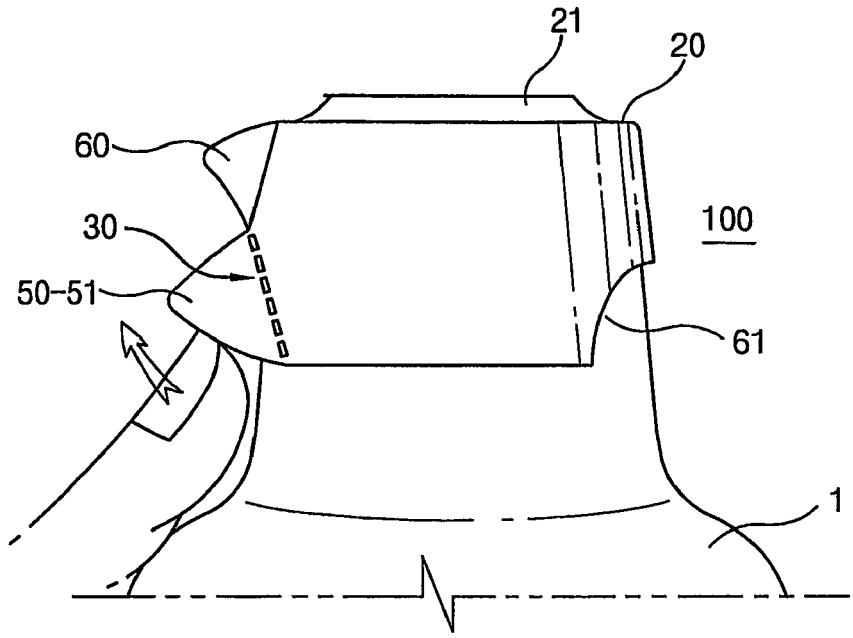
FIGS. 13 and 14 show another embodiment of the present invention.
Figure 14:
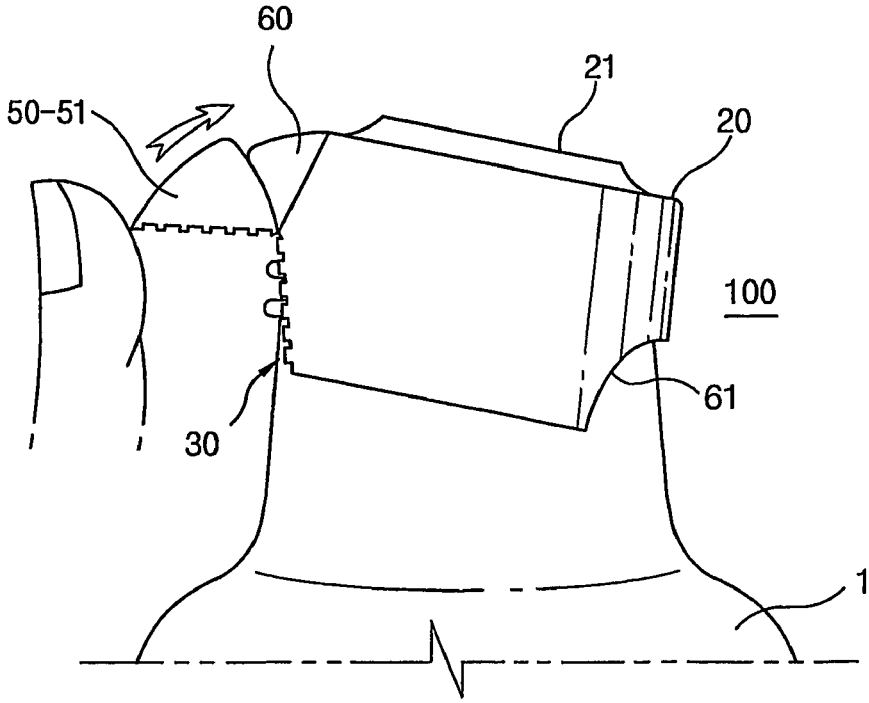
Figure 15:
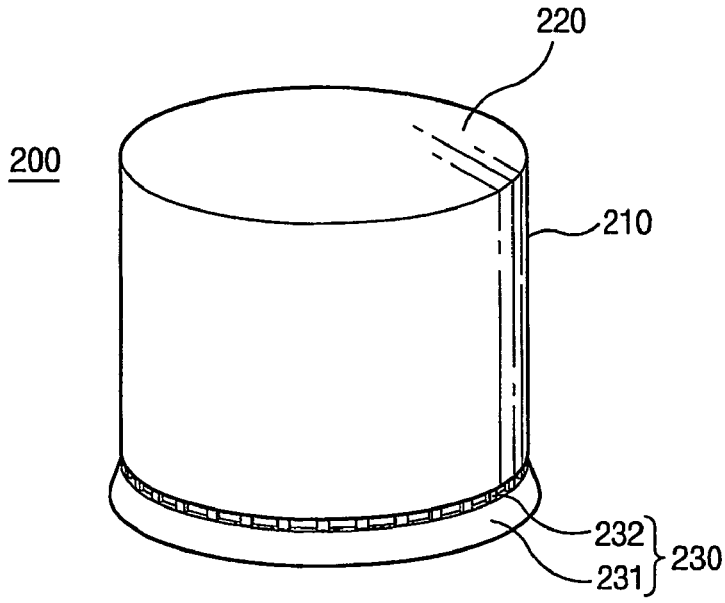
FIGS. 15 and 16 are views showing the construction of the conventional bottle cap.
Figure 16:
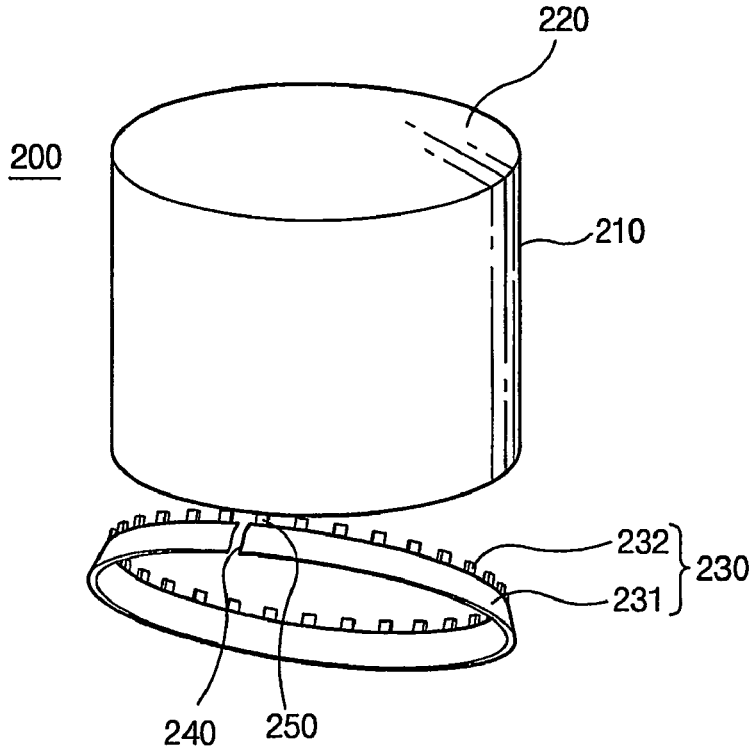

FIGS. 1 through 12 show the example of the bottle cap according to the present invention, in which FIG. 1 is a perspective view of the first embodiment, FIG. 2 is an operational view of the first embodiment, FIG. 3 is a perspective view of the second embodiment, FIG. 4 is a front view of the second embodiment, FIG. 5 is a partially cut-away view of the second embodiment, FIG. 6 is an operational view of the second embodiment, FIG. 7 is a transverse sectional view of the third embodiment, FIG. 8 is a perspective view of the opening of the bottle of the present invention, FIG. 9 is a transverse sectional view showing the state that the bottle cap of the third embodiment of the present invention is assembled with the bottle, FIG. 10 is a transverse sectional view showing the state that the bottle cap of the fourth embodiment is assembled with the bottle, FIG. 11 is a transverse sectional view showing the process that the power applied to the bottle cap of the fourth embodiment is transmitted, FIG. 12 is a bottom view of the bottle cap, and FIGS. 13 and 14 show another embodiment of the present invention.

As shown in FIGS. 1, 2 and 7, the bottle cap 100 according to the present invention basically has the construction that it is assembled with the adjacent portion 2 of the opening of the bottle 1, which is comprised of a circumferential portion 10 that is shaped to wrap up an outer surface of the adjacent portion 2 of the opening therein; a cap portion 20 that closes an upper side of the circumferential portion 10; a plurality of tamper indication portions 30 respectively extended from a central area of the circumferential portion 10 to a lower end thereof; a bending portion 40 that connects upper ends of the respective tamper indication portions 30 in a line; an opening piece portion 50 comprised of the plurality of tamper indication portions 30 and the bending portion 40; and a recess portion 70 so formed on an inner surface of the circumferential portion 10 as to prevent separation.

Further, as shown in FIG. 8, the bottle 1 with which the bottle cap 100 of the above construction is assembled has the construction that the adjacent portion 2 of the opening has a cross section of trapezoidal shape so that the lower end of an outer surface thereof is wider than the upper end thereof, and a protrusion 80 for prevent separation that is inserted to a recess 70 for preventing separation formed on an inner surface of the circumferential portion 10 of the bottle cap 100 is formed on an outer surface of the adjacent portion 2 of the opening.

In other words, a plurality of tamper indication portions 30 are respectively extended from a central area of the circumferential portion 10 to a lower end thereof, the bending portion 40 is formed at the upper end area of the tamper indication portions 30, and the opening piece portion 50 is formed by them. Therefore, the user can cut the tamper indication portion 30 (shown in FIGS. 6*a* and 6*b*) by moving the lower end of the opening piece portion 50 upward and downward around the bending portion 40 with his/her thumb while he/she is grasping the lower part of the bottle cap 100 on the bottle 1, and then separate the bottle cap 100 from the opening of the bottle 1 (shown in FIGS. 6*c* and 6*d*), so there is provided the construction that the bottle cap can be opened in a simple operation with one hand even though the tamper indication portion exists.

Further, the recess portion 70 for preventing separation is formed on the inner surface of the circumferential portion 10 of the bottle cap 100, a protrusion 80 for prevent separation is so formed to be inserted into the recess 70 for preventing separation on the outer surface of the adjacent portion 2 of the opening of the bottle 1, and the adjacent portion 2 of the opening of the bottle 1 has the cross section of trapezoidal shape so that the lower end thereof is wider than the upper end thereof. Meanwhile, as shown in FIG. 5, the recess portion 70 is formed on a position over a corresponding position that the bending portion 40 is formed.

Therefore, when the bottle cap 100 is pushed downward onto the bottle 1 from the upper side of the bottle 1, it is easy to assemble the bottle cap 100 with the bottle 1 without any trouble since the lower opening of the bottle cap 100 is wider than the upper opening of the bottle 1.

However, once the bottle 1 is closed by the bottle cap 100, the bottle cap 100 has to be pulled from the bottle 1 while the circumferential portion 10 of the bottle cap 100 is pushed by the hand. Such an operation inevitably causes the pressing between the recess portion 70 for preventing separation on the inner surface of the bottle cap 100 and the protrusion 80 for preventing separation on the outer surface of the bottle 1. Accordingly, the bottle cap 100 cannot be opened without the cutting of the tamper indication portion 30, and consequently, the bottle 1 is endowed with the confidence about the first opening.

Moreover, in order to guarantee the effect of preventing separation of the bottle cap 100 from the bottle 1, it is preferable that the recess portion 70 for preventing separation is formed to a ring shape along the inner surface of the circumferential portion 10, and it is more preferable that plural recess portions 70 are formed on upper and lower areas of the inner surface of the circumferential portion 10.

The present invention does not employ the opening method of twisting manner described above, so it is possible to secure the area for the advertisement or the like as the additional friction structure is not required on the circumferential portion 10 of the bottle cap 100, it is possible to reduce the height of the entire bottle cap 100 to reduce the costs as an additional screw structure or the like is not required on the inner surface of the circumferential portion 10 of the bottle cap 100, and it is also possible to increase the productivity as the manufacturing process can be simplified by a simple downward press process without the twist of the bottle cap 100 in equipping the bottle cap 100 onto the bottle 1.

Furthermore, the bottle cap 100 of the present invention has the construction that the bottle cap 100 can be opened by applying only a simple upward movement with one hand to the opening piece portion 50, wherein the reduction of the height of the entire bottle cap 100 can provide a side effect to make such an opening operation easier.

In such a situation, the number of the tamper indication portions 30 is not limited to a specific number if it is greater than two since they are formed along the circumferential portion 10 of the bottle cap 100 to form the opening piece portion 50, however, two that are spaced from each other are preferable in consideration of the manufacturing costs.

Furthermore, since the present invention has the construction that the opening piece portion 50 formed by cutting off the tamper indication portions 30 is moved upward, it is profitable that the lower end of the opening piece portion 50 is wide in order to secure the contacting area of the finger on the opening piece portion 50 and the bending portion 40 that is the axis of the upward movement of the opening piece portion 50 is narrow in order to secure the smooth bending. Therefore, it is profitable that the upper end of the opening piece portion 50 that forms the bending portion 40 is narrow.

Accordingly, in order to form the above construction of the opening piece portion 50, it is preferable that the interval between the lower ends of two tamper indication portions 30 constituting the opening piece portion 50 is wider than that of the upper ends thereof.

The tamper indication portions 30 is used for confirming whether the bottle cap has ever been opened or not, and in FIGS. 1 and 2, it is comprised of tamper indication recesses 31 formed by partially cutting away the circumferential portion 10; and a plurality of connection bridges 32 that connect the tamper indication recesses 31 so as to be cut off as the bottle cap 100 is opened, however, that is merely a general example and it is not limited to any type of construction if the opening piece portion 50 can be formed by cutting two tamper indication portions 30.

FIGS. 3 through 6 show the second embodiment of the present invention.

As shown in the figures, an opening knob 51 protruding outward of the outer side of the opening piece portion 50 is additionally provided.

Such a construction is aimed, when the user operates the opening piece portion 50 to move upward while one of his/her fingers is in contact with the lower end of the opening piece portion 50 in order to first open the bottle cap 100 of the present invention, to enlarge the contacting area between the finger and the opening piece portion 50 for the convenience of opening operation.

Further, the bottle cap 100 is perfectly opened by moving the opening piece portion 50 continuously around the axis of bending portion 40 after cutting off the tamper indication portions 30, and in such a situation, in order to transmit the upward force of the opening piece portion 50 to the overall bottle cap 100 more effectively, it is preferable that a supporting protrusion 60 is additionally provided which is so formed above the opening piece portion 50 on the outer surface of the circumferential portion 10 as to be contacted with the opening knob 51 of the opening piece portion 50 while the opening piece portion 50 is moved upward by the cutting of the connection bridges 32.

Further, in order to enhance the efficiency to transmit the power during the opening operation, it is required to prevent the sliding between the fingers and the opening knob 51 and between the opening knob 51 and the supporting protrusion 60, so it is preferable that a means for generating friction is additionally employed on the outer surface of the opening knob 51 and the supporting protrusion 60.

In this situation, the friction generating means can be realized by a knurling for generating the frictional force on the finger when the opening knob 51 is pushed by the finger, and any kinds of friction generating methods such as to make the surface rough, to form protrusions, or the like can be employed. However, the present embodiment exemplifies the wrinkled portion formed horizontally as an example of the knurling.

FIG. 6 shows the operation of the present embodiment.

The opening mechanism of the bottle cap 100 according to the present invention is illustrated with reference to the drawing.

After the user grasps the bottle 1 with his/her one hand, as the user moves the opening knob 51 of the opening piece portion 50 upward while the end of his/her thumb of the hand that grasps the bottle 1 is in contact with the opening knob 51 (FIG. 6*a*), the tamper indication portions 30 are cut off (FIG. 6*b*), and then the opening knob 51 is contacted with the supporting protrusion 60, by which the bottom side of the thumb is naturally contacted with the cut-off side of the opening knob 51 (FIG. 6*c*). The upward force by the thumb generates the twisting moment on the entire bottle cap 100 according to the above construction (FIG. 6*d*), whereby the power can be transmitted more effectively.

Next, the closing mechanism of the bottle cap 100 according to the present invention is illustrated.

FIGS. 7 through 12 illustrate such an operation.

The bottle cap 100 of the present invention is opened and closed not by the twisting manner but only by the upward force of one finger, so the closing operation is also performed by such a manner as to push down the bottle cap 100 from the right above of the opening of the bottle 1.

For the stable assembly of the bottle cap 100, a protrusion 80 for preventing separation that is inserted to a recess 70 for preventing separation formed on an inner surface of the circumferential portion 10 of the bottle cap 100 is formed on an outer surface of the adjacent portion 2 of the opening of the bottle, the circumferential portion 10 is formed by an elastic material so that the area of the opening at the lower end thereof can be changed, and the adjacent portion 2 of the bottle is so formed to have the cross section of trapezoidal shape that the lower end of the outer surface thereof is wider than the upper end thereof.

Accordingly, as the bottle cap 100 is pushed to be assembled, the inner surface of the circumferential portion 10 of the bottle cap 100 that is made of elastic material presses the outer surface of the adjacent portion 2 of the opening of the bottle 1 so as to strengthen the assembly between the protrusion 80 for preventing separation and the recess 70 for preventing separation, whereby the separation of the bottle cap 100 is prevented and the stable assembly can be achieved.

The circumferential portion 10 of the bottle cap 100 can be constituted to have the cross section of rectangular shape or trapezoidal shape, and if the bottle 1 of trapezoidal cross section is employed, the lower end of the circumferential portion 10 is expanded elastically to result in the trapezoidal shape of bottle cap 100 after being assembled with the bottle 1.

Accordingly, in order to have the rectangular shape after the bottle cap 100 is assembled with the bottle 1, as shown in FIG. 9, it is preferable that the thickness of the upper part of the circumferential portion 10 of the bottle cap 100 is greater than the lower part thereof.

When such a construction is employed, the thickness of the tamper indication portions 30 becomes thin at the lower area of the circumferential portion 10 of the bottle cap 100 and the thickness thereof becomes relatively thick at the upper area thereof, by which an additional effect is achieved that the tamper indication portions 30 can be cut off more easily.

Further, in such a construction, in order to transmit the downward force applied to the cap portion 20 of the bottle cap 100 to the circumferential portion 10 of the bottle cap 100 effectively, it is preferable that a closing knob 21 protruding upward at a central area from the upper side of the cap portion 20 is additionally provided.

In such a situation, it is preferable that a recess portion 22 for increasing elastic force is formed on the inner side of the closing knob 21.

As shown in FIG. 11, according to such a construction, the lower end of the circumferential portion 10 is easily opened elastically when the closing of the bottle cap 100 is started (designated by solid arrow), and the inner surface of the circumferential portion 100 of the bottle cap 100 is naturally pressed elastically onto the outer surface of the bottle 1 by the rising up of the closing knob 21 after the closing of the bottle cap 100 is finished (designated by dotted arrow).

Meanwhile, FIGS. 13 and 14 show another embodiment of the present invention, which are the drawings similar to the above FIGS. 6*a* and 6*d*, respectively.

In the present embodiment, a cut-away portion 61 is formed on the circumferential portion 10. The cut-away portion 61 is preferably formed on the side opposite to the opening knob 50 on the circumferential portion 10, and is formed by cutting away the lower end area of the circumferential portion 10 at certain size and shape. As such a cut-away portion 61 is formed, when the opening knob 51 is pushed by finger as shown in FIG. 13 to open the bottle cap 100, the bottle cap 100 pivots about the upper edge of the cut-away portion 61 as shown in FIG. 14. Accordingly, in comparison with the case that the cut-away portion 61 does not exist, the pivoting axis of the bottle cap 100 is located at the higher position on the circumferential portion 10 to make it easy to pivot the bottle cap 100, and therefore, it is easier to open the bottle cap 100.

Meanwhile, the present embodiment shows the example that only a single opening piece portion 50 is formed, however, as a modification of the present embodiment, a plurality of opening piece portions 50 can be formed on positions different from each other on the circumferential portion 10. In such a situation, the arrangement of the opening piece portions 50 can be modified to a variety of manners such as to form on the opposite sides on the circumferential portion 10, or to form three or more opening piece portions 50 in a radial manner.

INDUSTRIAL APPLICABILITY

According to the bottle cap and the bottle with the same of the present invention, it is possible to open and close the bottle cap merely with a simple operation with a single hand, to secure the area for the advertisement or the like sufficiently, to reduce the manufacturing costs by reducing the height of the bottle cap, and to increase the productivity by simplifying the manufacturing process.

The preferred embodiments have been illustrated and described so far, however, it will be understood by those skilled in the art that various changes and modifications can be made within the spirit and the scope of the present invention, and accordingly, the scope of the present invention is not limited within the described range but the following claims and the equivalents thereof.

What is claimed is:

1. A bottle cap that is detachably assembled with an adjacent portion of an opening of a bottle, the bottle cap comprising:

a circumferential portion that is shaped to wrap up an outer surface of the adjacent portion of the opening therein;

a cap portion that closes an upper side of the circumferential portion;

a plurality of tamper indication portions respectively extended from a central area of the circumferential portion to a lower end thereof, which is cut off as the bottle cap is opened;

a bending portion that connects upper ends of the respective tamper indication portions in a line;

an opening piece portion comprised of the plurality of tamper indication portions and the bending portion;

a recess portion so formed on an inner surface of the circumferential portion on a position over the bending portion as to prevent separation;

an opening knob protruding outward of an outer surface of the opening piece portion, the opening knob being configured to be capable of being moved upward by a thumb of user's one hand while the user's one hand is grasping the bottle; and a supporting protrusion that is so formed above the opening piece portion on the outer surface of the circumferential portion as to be contacted with the opening knob of the opening piece portion while the opening piece portion is moved upward by a cutting of the tamper indication portion, wherein, as the user moves the opening knob upward by the thumb of the user's one hand grasping the bottle, the tamper indication portion is cut off and then the opening knob is contacted with the supporting protrusion, whereby the use can open the bottle cap with a single hand.

2. The bottle cap according to claim 1, wherein two tamper indication portions spaced from each other are formed.

3. The bottle cap according to claim 2, wherein said two tamper indication portions are so formed that a distance between lower portions thereof are greater than the distance between upper portions thereof.

4. The bottle cap according to claim 1, further comprising a friction generating means provided on an outer surface of the opening knob.

5. The bottle cap according to claim 4, wherein the friction generating means is a knurling.

6. The bottle cap according to claim 5, wherein the knurling is a wrinkled portion formed horizontally.

7. The bottle cap according to claim 1, wherein the circumferential portion is so formed that a thickness of the upper portion thereof is greater than the thickness of the lower portion thereof

8. The bottle cap according to claim 1, further comprising a closing knob protruding upward at a central area from the upper side of the cap portion.

9. The bottle cap according to claim 8, further comprising a recess portion formed on an inner side of the closing knob, the recess portion for increasing elastic force.

10. The bottle cap according to claim 1, the recess portion for preventing separation is formed to a ring shape along the inner surface of the circumferential portion.

11. The bottle cap according to claim 10, wherein a plurality of said recess portions are formed on upper and lower areas of the inner surface of the circumferential portion.

12. The bottle cap according to claim 1, further comprising a cut-away portion formed on a side opposite to the opening piece portion on the circumferential portion, the cut-away portion being formed by cutting away a lower end area of the circumferential portion at a certain size.

13. The bottle cap according to claim 1, wherein a plurality of opening piece portions is formed respectively on positions different from each other on the circumferential portion.

14. A bottle cap that is detachably assembled with an adjacent portion of an opening of a bottle, the bottle cap comprising:

a circumferential portion that is shaped to wrap up an outer surface of the adjacent portion of the opening therein, the circumferential portion being formed to have a cross section of trapezoidal shape so that a lower portion of the inner surface thereof is wider than an upper portion thereof, and being formed by an elastic material so that an area of an opening at a lower end thereof can be changed;

a cap portion having a closing knob protruding upward at a central area of an upper side thereof, the cap portion for closing an upper side of the circumferential portion;

two tamper indication portions respectively having tamper indication recesses formed by partially cutting away the circumferential portion, and connection bridges that connect the tamper indication recesses so as to be cut off as the bottle cap is opened, the tamper indication portions respectively extended from a central area of the circumferential portion to a lower end thereof and being so formed that a distance between lower portions thereof are greater than the distance between upper portions thereof;

a bending portion that connects upper ends of the respective tamper indication portions in a line;

an opening piece portion comprised of said two tamper indication portions and the bending portion, the opening piece portion having an opening knob protruding outward of an outer surface thereof, the opening piece portion being configured to be capable of being moved upward by a thumb of user's one hand while the user's one hand is grasping the bottle;

a supporting protrusion that is formed above the opening piece portion on the outer surface of the circumferential portion so as to be contacted with the opening knob of the opening piece portion while the opening piece portion is moved upward by a cutting of the connection bridges;

a knurling portion formed on an outer surface of the opening knob and the supporting protrusion;

a recess portion formed to a ring shape along an inner surface of the circumferential portion on a position over the bending portion, the recess portion for preventing separation;

a closing knob protruding upward at a central area from the upper side of the cap portion; and another recess portion formed on an inner side of the closing knob, the recess portion for increasing an elastic force, wherein, as the user moves the opening knob upward by the thumb of the user's one hand grasping the bottle, the tamper indication portion is cut off and then the opening knob is contacted with the supporting protrusion, whereby the user can open the bottle cap with a single hand.

15. A bottle on which the bottle cap according to claim 1 is detachably assembled with an adjacent portion of an opening thereof, wherein the adjacent portion of the opening has a cross section of trapezoidal shape so that a lower end of an outer surface thereof is wider than an upper end thereof, and a protrusion for prevent separation that is inserted to a recess for preventing separation formed on an inner surface of the circumferential portion of the bottle cap is formed on an outer surface of the adjacent portion of the opening.

* * * * *